US006272713B1

(12) United States Patent
Lotwin

(10) Patent No.: US 6,272,713 B1
(45) Date of Patent: Aug. 14, 2001

(54) INTERNAL PIPE CLEANING DEVICE

(76) Inventor: Robert P. Lotwin, 4 Millpark Place S.W., Calgary (CA), T2Y 2N3

( * ) Notice: Subject to any disclaimer, the term of this patent is extended or adjusted under 35 U.S.C. 154(b) by 0 days.

(21) Appl. No.: 09/447,264

(22) Filed: Nov. 23, 1999

(30) Foreign Application Priority Data

Dec. 11, 1998 (CA) ..... 2255499

(51) Int. Cl.[7] ..... B08B 9/055
(52) U.S. Cl. ..... 15/104.061
(58) Field of Search ..... 15/3.5, 104.05, 15/104.061, 104.068, 104.16

(56) References Cited

U.S. PATENT DOCUMENTS

| | | | | |
|---|---|---|---|---|
| 2,258,174 | * | 10/1941 | Chawner | 15/104.061 |
| 2,539,354 | * | 1/1951 | Minyard | 15/104.061 |
| 4,336,074 | * | 6/1982 | Dinkelacker | 15/104.061 |
| 4,406,030 | * | 9/1983 | Platts | 15/104.061 |
| 4,550,466 | * | 11/1985 | Schmitz | 15/104.061 |
| 5,105,498 | * | 4/1992 | Dinkelacker | 15/104.061 |

FOREIGN PATENT DOCUMENTS

| | | | | |
|---|---|---|---|---|
| 1214853 | * | 4/1960 | (FR) | 15/104.061 |
| 603441 | * | 4/1978 | (SU) | 15/104.061 |

* cited by examiner

*Primary Examiner*—Terrence R. Till
(74) *Attorney, Agent, or Firm*—Thomas E. Malyszko

(57) ABSTRACT

The invention is an elastomer device with a generally spherical shape for cleaning pipelines and has the ability to reduce in size for changes in pipe internal diameter due to wall thickness changes and provides a cleaning and scraping ability. In particular, the device has three dimensional geometric shapes radiating from the outside surface of a spherical core. The flex of the walls of the three dimensional geometric structure provides the movement to reduce the diameter of the device when encountering smaller internal diameters of heavy wall pipe. The interference fit of the oversize of the device's diameter, combined with the edges and outside surface of the three dimensional geometric structure, provides a sealing and scraping ability. The pattern of the geometric shape, the wall thickness of the walls forming the pattern, and depth of the cell created by the walls, are all critical to the performance of the device.

19 Claims, 1 Drawing Sheet

INTERNAL PIPE CLEANING DEVICE

FIELD OF THE INVENTION

Figure 1:
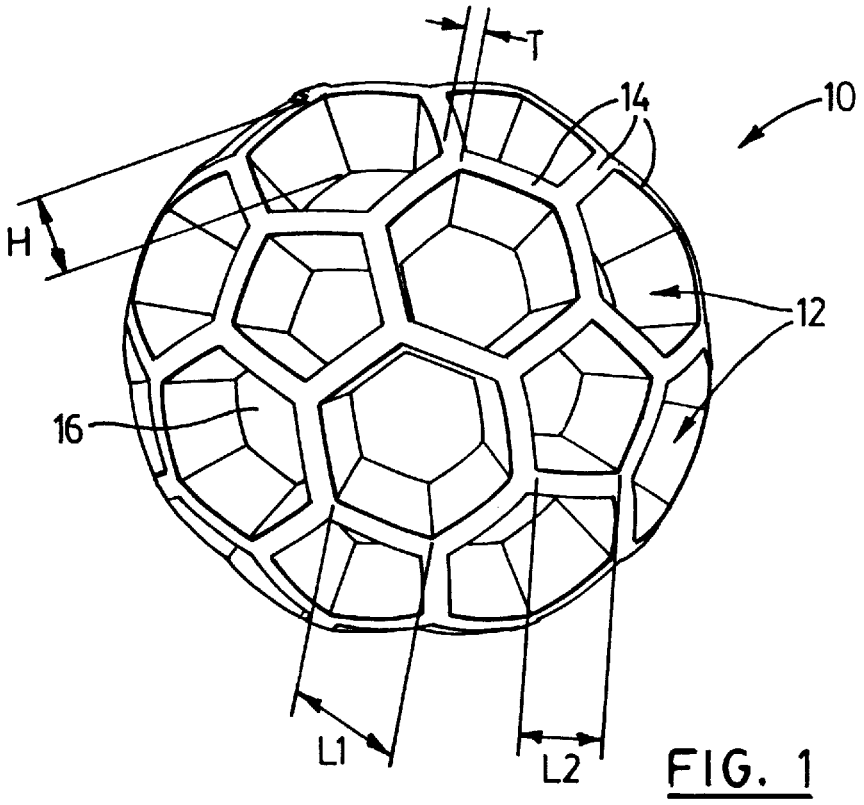

The present invention relates to the cleaning of piping systems both above and below grade, and in particular where system configuration or operator preference requires the use of a cleaning device of spherical shape to travel through piping. Devices for cleaning pipe are commonly referred to as "pigs" and the procedure as "pigging".

BACKGROUND OF THE INVENTION

Devices called pigs are used to clean piping systems for removal of materials that affect flow efficiency or removal of materials that can be corrosive to the system. Pigs use an oversize fit to create a seal so that it can be pushed through the system by gas or liquid (i.e. fluid) pressure. In most cases the product in the system is used to propel the pig. The oversize interference fit provides a cleaning action.

In contemporary piping systems there has been a trend to use high yield strength thin wall pipe for buried pipe, as is allowed by piping codes, because it is less expensive to build a system with this pipe than lower yield strength heavy wall pipe. Where the system comes above grade at the inlet and outlet end, heavier wall pipe is used according to accepted design codes and corrosion allowance. Heavier wall pipe is often used when a buried system crosses beneath roads, rivers, streams and lakes.

The result of this mix of pipe is a change in internal diameter. Pipe outside diameter of any nominal size remains the same as is standard in the pipe industry. The internal diameter reduces with an increase in wall thickness. Conventional pigs utilizing cups, discs, scrapers and brushes with a central post or mandrel can be designed to flex or move to accommodate internal diameter changes where piping system design allows for their long length.

Spheres or balls are used for pigging piping systems where the shape of fittings only allow a spherical pig to pass through. For example, systems that have many branch lines often are collected into a header system that uses tee connections between the branch line and the header. The only shape that can change direction laterally in a round pipe is a sphere. In addition, some pig launching and receiving devices are designed to accept spherical pigs only.

Sphere pigs are presently manufactured as solid elastomer, foam core with an elastomer skin or wall, and hollow and inflatable elastomer. All have disadvantages.

Solid spheres do not reduce diameter easily when required, and the smooth surface does not have any scraping ability. Because solid elastomer sphere pigs do not compress easily when there are internal diameter changes, they must be sized for piping at the launch and receive end of a piping system for the ability to manually insert the pig into the heavier wall pipe and for the ability to move through the system with reasonable pressure. This then makes the sphere too small to seal or clean in typical thin wall pipe sections where the internal diameter increases. Further, a smooth or relatively smooth spherical shape has no scraping edges to allow effective cleaning.

The elastomer skin of foam core sphere pigs easily cuts and tears which reduces usable life. The foam core which is open cell can absorb product from the system which can be toxic and/or volatile, making them dangerous to handle or transport. Inflatable sphere pigs are filled with liquid (usually a water and glycol mix) to inflate them to the required diameter. Once the sphere is inflated it is not flexible for change in internal diameter.

Inflatable spheres are complicated and expensive to manufacture, requiring inflation valves to be manufactured into the sphere and special, expensive equipment is required to inflate them. If the elastomer shell or wall should be cut or tear, the sphere will deflate and lose the seal required for travel through the pipe.

None of these spherical designs have deep scraping edges perpendicular to the pipe wall to make them effective scrapers. Some spheres have wire brush strips bonded to the outside surface for scraping but they lose the pressure seal through the bristles which can cause them to slow or stop. The bristle strips also add structure so the sphere it is even more firm and will not reduce for pipeline diameter changes.

There is therefore a need for an effective sealing and scraping spherical pig for use in piping systems designed to only allow for spheres, or because of operator preference. The pig should be generally spherical to fit or travel through pipe anomalies (e.g. elbows, tees, etc.), it should transition through internal diameter changes while still maintaining a pressure seal and yet should provide aggressive scraping action.

SUMMARY OF THE PRESENT INVENTION

The device of the present invention is intended for cleaning and displacing materials in gas and liquid piping system, where often there is a mix of larger and smaller internal diameters due to changes in wall thickness, and short radius bends or side branch turns, while being propelled by the gas or liquid. The design allows the device to flex through varying internal diameters of pipe and fittings. The shape of the three dimensional geometric pattern radiating from the device's inner core and perpendicular to pipe wall surface provides a pressure seal and scraping action not provided by a relatively smooth spherical shape.

In one aspect, therefore, the invention provides a cleaning device for the interior of a pipeline comprising:

- a body having a core portion and a generally spherical outer portion about said core portion, said outer portion having a plurality of spaced cells defining a plurality of interconnected elongate wall members of resilient material extending radially from said core portion to define an outer edge portion for engaging said interior of said pipeline to form a pressure tight seal therewith to scrape and clear said interior of unwanted substances as said body travels through said pipeline.

In another aspect the invention provides a device for cleaning the interior of a pipe comprising:

- a body having an inner core and a generally spherical outer shell of resilient material enveloping said inner core, said outer shell being formed by an interconnecting pattern of elongate wall members extending circumferentially along said inner core and extending radially from said inner core to define a plurality of outer edges, said outer edges engaging said interior of said pipe to form an interference fit therewith for allowing said body to be propelled through said pipe by a pressurized fluid, wherein said outer edges form scraping means to scrape said interior and displace any foreign substances as said body is propelled therethrough.

In yet another aspect, the invention provides a device for cleaning inside a pipeline carrying a fluid under pressure comprising:

- a core of resilient material;
- a generally spherical shell of resilient material surrounding said core;

said shell having a plurality of spaced cavities defining a geometric pattern of elongate wall members extending radially from said core to define outer edges;

said core and wall members being sized so that said outer edges form an interference fit inside said pipeline; and, said wall members being arranged so that said shell forms an adequate seal inside said pipeline to allow said device to be propelled through said pipeline by said fluid to dislodge and clear said pipeline of foreign substances.

BRIEF DESCRIPTION OF THE DRAWING FIGURES

Figure 2:
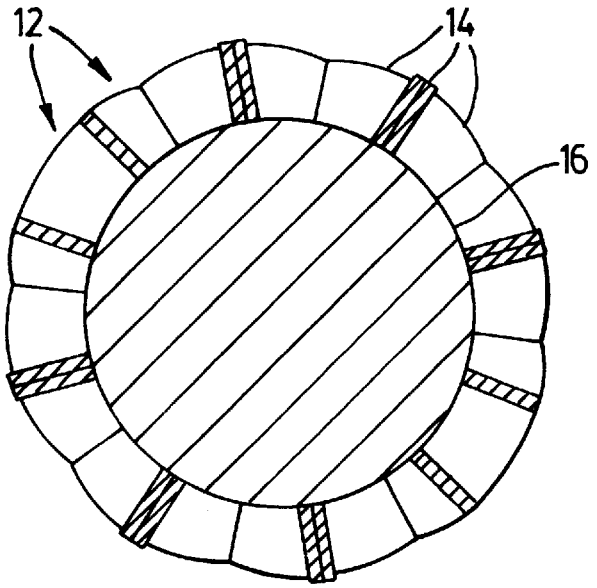

Embodiments of the invention will now be described, by way of example only, with reference to the accompanying drawings, wherein:

FIG. 1 is an elevation view of an internal pipe cleaning device according to the present invention; and, FIG. 2 is a cross-sectional view of the device of FIG. 1.

DESCRIPTION OF PREFERRED EMBODIMENTS

The pig of the present invention is cast from a elastomer material and has a generally spherical outer shape. It incorporates a complex, deep, three dimensional geometric structure on the outside surface. There is a relationship between the depth of each cell created by the three dimensional geometric structure and the variance in internal diameters it is designed to transition through.

The thickness and height of the walls comprising the geometric structure have a relationship to the flexibility of the chosen elastomer material to provide the flex necessary to transition through a range of pipe internal diameters and to function as perpendicular scrapers while maintaining good abrasion and tear characteristics.

The outside diameter and inner core diameter is determined by the variance in internal pipe diameters that the device is designed to transition through. These diameters provide the foundation dimensions for the walls forming the geometric openings or cells.

One embodiment of the pig, indicated by reference numeral (10), is shown in the figures. Openings or cells (12) formed by walls (14) result in a mix of hexagon and pentagon shapes over the entire surface of the pig. The walls (14) need to be flexible enough to deform, yet rigid enough to scrape the inside of a pipe, and strong enough to avoid tearing of the walls. The wall height (H) and thickness (T) is important to these functions. The walls radiate inwardly towards the solid center or spherical core (16) of pig. The wall thickness (T) varies slightly in a radial direction to the core (16) namely each wall (14) is about the same to slightly thicker at the outer periphery than at the inner core.

By way of example, a 3 inch nominal size pig that has provided good results in a 3.25 inch internal diameter pipe has the following approximate dimensions:

a pig outside diameter of 3.375 inches (about 8.57 cm);

a wall height of "H" of 0.500 inches (about 1.27 cm);

a wall thickness "T" at the outer periphery of 0.150 inches ( about 0.38 cm);

is a wall length "L1" of 0.560 inches (about 1.42 cm);

a wall length "L2" of 0.560 inches (about 1.42 cm); and a core diameter 2.375 inches (about 6.03 cm).

Another example of pig dimensions providing good results for a 2.98 inch internal diameter pipe are:

a pig outside diameter of 3.10 inches (about 7.87 cm);

a wall height of "H" of 0.500 inches (about 1.27 cm);

a wall thickness "T" at the outer periphery of 0.150 inches ( about 0.38 cm);

a wall length "L1" of 0.500 inches (about 1.27 cm);

a wall length "L2" of 0.500 inches (about 1.27 cm); and a core diameter 2.10 inches (about 5.33 cm).

Dimensions will be proportionally adjusted as required for different internal pipe diameters, variance in internal diameters due to pipe wall thickness change, and to make the pig walls either stiffer or more flexible as required by the application.

The dimensions of the walls (14), namely H, T, L1 and L2, will vary proportionally with specific outside pig (10) diameters and core (16) diameters of the pigs. A desireable elastomer material used to construct the pig is a polyurethane because it provides most of the physical properties required by the invention, namely flex and strength. Other flexible elastomers may be suitable for specific applications, such as those with appropriate temperature and chemical resistance.

I claim:

1. A cleaning device for the interior of a pipeline comprising:

a body having a core portion and a generally spherical outer portion about said core portion, said outer portion having a plurality of spaced cells defining a plurality of interconnected elongate wall members of resilient material extending radially from said core portion to define an outer edge portion for engaging said interior of said pipeline to form a pressure tight seal therewith to scrape and clear said interior of unwanted substances as said body travels through said pipeline.

2. The device of claim 1 wherein said core portion comprises a generally spherical body of resilient material.

3. The device of claim 2 wherein said resilient material of said core portion and of said outer portion comprises an elastomeric material.

4. The device of claim 1 wherein said cells comprise a configuration of geometrically shaped cavities closed at one end by said core portion and open at an opposed end to the ambient.

5. The device of claim 4 wherein the circumferential length of each wall member is substantially equal.

6. The device of claim 4 wherein the radial height of each wall member is at least equal to its circumferential length.

7. The device of claim 1 wherein the thickness of said wall members is greater at said outer edge than adjacent said inner core.

8. A device for cleaning the interior of a pipe comprising:

a body having an inner core and a generally spherical outer shell of resilient material enveloping said inner core, said outer shell being formed by an interconnecting pattern of elongate wall members exending circumferentially along said inner core and extending radially from said inner core to define a plurality of outer edges, said outer edges engaging said interior of said pipe to form an interference fit therewith for allowing said body to be propelled through said pipe by a pressurized fluid, wherein said outer edges form scraping means to scrape said interior and to displace any foreign substances as said body is propelled therethrough.

9. The device of claim 8 wherein said wall members are arranged to form a plurality of hexagon and pentagon shaped chambers closed at one end by said inner core and open to the ambient at an opposed end.

10. The device of claim 9 wherein said wall members are tapered from said inner core toward said outer edges.

11. The device of claim 8 wherein said wall members are tapered from said inner core toward said outer edges.

12. The device of claim 8 wherein said inner core comprises a generally spherical body of resilient material.

13. A device for cleaning inside a pipeline carrying a fluid under pressure comprising:

a core of resilient material;

a generally spherical shell of resilient material surrounding said core;

said shell having a plurality of spaced cavities defining a geometric pattern of elongate wall members extending radially from said core to define outer edges;

said core and wall members being sized so that said outer edges form an interference fit inside said pipeline; and, said wall members being arranged so that said shell forms an adequate seal inside said pipeline to allow said device to be propelled through said pipeline by said fluid to dislodge and clear said pipeline of foreign substances.

14. The device of claim 13 wherein said outer edges are adapted to scrape the inside of said pipeline as said device is propelled therethrough.

15. The device of claim 13 wherein said core has a generally spherically shaped exterior surface.

16. The device of claim 15 wherein said resilient material of said core and shell comprises an elastomeric material.

17. The device of claim 16 wherein said wall members are tapered from said inner core toward said outer edges.

18. The device of claim 17 wherein the circumferential length of each wall member is substantially equal.

19. The device of claim 18 wherein said geometric pattern forms a arrangement of hexagon and pentagon shaped cavities.

* * * * *